US009096346B2

(12) United States Patent
Huffer et al.

(10) Patent No.: US 9,096,346 B2
(45) Date of Patent: Aug. 4, 2015

(54) FLEXIBLE PACKAGE STRUCTURE WITH A PRESS-AND-PULL OPENING FEATURE

(71) Applicant: Sonoco Development, Inc., Hartsville, SC (US)

(72) Inventors: Scott William Huffer, Hartsville, SC (US); Robert Carpenter, Darlington, SC (US)

(73) Assignee: Sonoco Development, Inc., Hartsville, SC (US)

( * ) Notice: Subject to any disclaimer, the term of this patent is extended or adjusted under 35 U.S.C. 154(b) by 160 days.

(21) Appl. No.: 13/961,484

(22) Filed: Aug. 7, 2013

(65) Prior Publication Data

US 2015/0041470 A1 Feb. 12, 2015

(51) Int. Cl.
*B65D 17/00* (2006.01)
*B65D 77/20* (2006.01)

(52) U.S. Cl.
CPC ..... *B65D 17/163* (2013.01); *B65D 77/2056* (2013.01); *B65D 2577/205* (2013.01); *B65D 2577/2091* (2013.01)

(58) Field of Classification Search
CPC ..... B65D 17/163; B65D 77/2056
USPC ..... 220/270, 266, 359.1, 359.2, 359.3; 215/232, 251, 253
See application file for complete search history.

(56) References Cited

U.S. PATENT DOCUMENTS 3,290,856 A * 12/1966 Rumberger ..... 53/471
3,951,331 A * 4/1976 Smith et al. ..... 229/123.2
4,693,390 A 9/1987 Hekal
4,801,041 A 1/1989 Takata et al.
4,961,513 A * 10/1990 Gossedge et al. ..... 220/276
5,064,537 A * 11/1991 Chupka et al. ..... 210/497.01
5,118,002 A * 6/1992 Sugiyama et al. ..... 220/270
5,158,499 A 10/1992 Guckenberger
5,316,603 A * 5/1994 Akazawa et al. ..... 156/69
6,056,141 A * 5/2000 Navarini et al. ..... 220/269

(Continued)

FOREIGN PATENT DOCUMENTS

EP 1 544 127 A1 6/2005
EP 2 266 894 12/2010

(Continued)

OTHER PUBLICATIONS

International Search Report and Written Opinion for Application No. PCT/US2014/043194 dated Sep. 26, 2014.

*Primary Examiner* — Steven A. Reynolds
*Assistant Examiner* — King M Chu
(74) *Attorney, Agent, or Firm* — Alston & Bird LLP

(57) ABSTRACT

An opening feature for a flexible laminate membrane having a metal foil layer sandwiched between first and second structures is formed by a first score line through a thickness of the first structure but not breaching the metal foil layer, and a second score line through a thickness of the second structure but not breaching the metal foil layer, the first and second score lines together encompassing a removable panel portion of the flexible membrane. A press-and-pull tab constituting part of the removable panel portion is arranged to be pressed downward to cause the metal foil layer to break in the region of the tab, and then to be grasped and pulled upward to cause the metal foil layer to break all around a periphery of the removable panel portion to enable the removable panel portion to be completely removed from the flexible membrane.

12 Claims, 8 Drawing Sheets

(56) References Cited

U.S. PATENT DOCUMENTS

| | | | | |
|---|---|---|---|---|
| 6,182,850 | B1 | 2/2001 | Marbler et al. | |
| 6,460,720 | B1 * | 10/2002 | Massey et al. | 220/359.1 |
| 6,474,490 | B1 * | 11/2002 | Seibel et al. | 215/232 |
| 7,703,625 | B2 | 4/2010 | Westphal | |
| 7,740,730 | B2 * | 6/2010 | Schedl et al. | 156/290 |
| 8,079,475 | B2 | 12/2011 | McArthur et al. | |
| 8,242,915 | B2 * | 8/2012 | Yan et al. | 340/572.8 |
| 8,256,636 | B2 | 9/2012 | Huffer | |
| 8,523,837 | B2 * | 9/2013 | Wiggins et al. | 604/414 |
| 2004/0013827 | A1 * | 1/2004 | Zuser et al. | 428/34.1 |
| 2005/0150891 | A1 * | 7/2005 | Schalk et al. | 220/266 |
| 2005/0284789 | A1 | 12/2005 | Carespodi | |
| 2007/0125781 | A1 | 6/2007 | Schuetz et al. | |
| 2007/0164094 | A1 * | 7/2007 | Takahashi | 229/123.1 |
| 2008/0073308 | A1 * | 3/2008 | Yousif | 215/232 |
| 2008/0283529 | A1 | 11/2008 | Westphal | |
| 2011/0147353 | A1 | 6/2011 | Kornfeld et al. | |
| 2011/0248034 | A1 | 10/2011 | Hosele | |
| 2011/0262589 | A1 | 10/2011 | Safarik | |
| 2012/0306189 | A1 * | 12/2012 | Stewart et al. | 283/67 |
| 2013/0078401 | A1 | 3/2013 | Tang | |

FOREIGN PATENT DOCUMENTS

| | | | |
|---|---|---|---|
| EP | 2 599 735 | A1 | 6/2013 |
| JP | H01 144327 | U | 10/1989 |
| WO | WO 2007/018396 | A2 | 2/2007 |

* cited by examiner

FLEXIBLE PACKAGE STRUCTURE WITH A PRESS-AND-PULL OPENING FEATURE

BACKGROUND OF THE INVENTION

The present disclosure relates to flexible package structures, and particularly to opening features for flexible package structures.

There are various known containers having a general can-type configuration in which the top end of the can is closed by a lid structure that is either partially or entirely formed by a flexible membrane. One such type of container has a lid structure comprising a metal ring to which a flexible membrane is sealed. The metal ring is affixed to the can in suitable fashion and is not intended to be removed. To open the container, the membrane is peeled off the metal ring. Another such type of container has a composite paperboard and plastic can body and the lid structure is a flexible membrane that is sealed to the top rim of the can body. The lid is peeled from the top rim to open the container.

The metal ring-and-membrane type of lid is relatively costly because of the metal ring component. The all-membrane type of lid is less costly, but it is difficult to achieve a proper balance between a strong-enough seal to keep the lid from inadvertently becoming detached during shipping and handling, and a weak-enough seal to make opening the container feasible for a wide range of consumers, some of whom (such as the elderly) may have low grip strength.

It would be desirable to provide an alternative type of opening feature for a flexible package structure that does not require any costly component such as a metal ring, and does not require any peel seal that must be broken to open the container.

BRIEF SUMMARY OF THE DISCLOSURE

The present disclosure describes a container at least part of which is formed by a flexible membrane having a press-and-pull opening feature, wherein:

- the flexible membrane comprises a laminate of a metal foil layer having a first side and an opposite second side, a first non-metal structure adhered via a first adhesive layer to the first side of the metal foil layer, and a second non-metal structure adhered via a second adhesive layer to the second side of the metal foil layer; and
- the press-and-pull opening feature comprises:
  - a first score line forming a complete loop and extending through a thickness of the first structure but not breaching the metal foil layer;
  - a second score line forming a complete loop and extending through a thickness of the second structure but not breaching the metal foil layer, the first and second score lines together encompassing a removable panel portion of the flexible membrane, wherein the flexible membrane includes an outlying portion that completely surrounds the removable panel portion; and
  - a press-and-pull tab constituting part of the removable panel portion, wherein a segment of the first score line and a corresponding segment of the second score line separate an outer edge of the press-and-pull tab from the outlying portion of the flexible membrane, and wherein the press-and-pull tab is arranged to first be pressed downward generally normal to the flexible membrane to cause the metal foil layer to break in the region of the outer edge of the press-and-pull tab so as to sever the outer edge of the press-and-pull tab from the outlying portion of the flexible membrane, and then to be grasped and pulled upward to cause the metal foil layer to break all around a periphery of the removable panel portion to enable the removable panel portion to be completely removed from the flexible membrane.

As described herein, pressing "downward" refers to pressing in a direction generally toward the interior or the container, without regard to the actual orientation of the container with respect to the gravitational direction, and similarly pulling "upward" refers to pulling in a direction generally away from the interior of the container regardless of container orientation. The "downward" and "upward" directions are generally normal to the plane of the flexible membrane.

In some embodiments, at least in the vicinity of the press-and-pull tab the second score line is offset from the first score line, and the first adhesive layer is absent in a region bounded between the offset first and second score lines. The first and second score lines can be offset from one another all around the periphery of the removable panel portion. The "knock-out" or adhesive-free region between the offset score lines helps to weaken the laminate where the press-and-pull tab is located, so that the foil layer is more-readily broken when the tab is pressed.

The flexible membrane with press-and-pull opening feature can be incorporated into various types and configurations of containers. In one embodiment, the container comprises a can body having an upper rim, and the flexible membrane comprises a lid attached to the upper rim. The outlying portion of the membrane surrounding the removable panel portion is sealed to the upper rim. The removable panel portion of the flexible membrane is not sealed to the upper rim. Accordingly, the outlying portion remains sealed to the upper rim when the removable panel portion is removed.

The upper rim and the lid each can have a plan view shape selected from the group consisting of round, non-round, and polygonal. Generally, the removable portion of the flexible membrane can have a plan view shape geometrically similar to that of the lid.

In another embodiment, the container comprises a bag or pouch constructed of the flexible membrane. The press-and-pull opening feature can be located in a front wall of the bag or pouch.

In any of the various embodiments, the first structure can comprise at least a first polymer film layer and the second structure can comprise at least a second polymer film layer. The flexible membrane in some embodiments can consist only of metal foil, polymer, and adhesive materials.

The second structure additionally can comprise a third polymer film layer, wherein the second polymer film layer has one surface adhered to the second side of the metal foil layer, and the third polymer film layer is disposed adjacent an opposite surface of the second polymer film layer. The third polymer film layer can be a sealant material such as a heat-sealable material.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1:
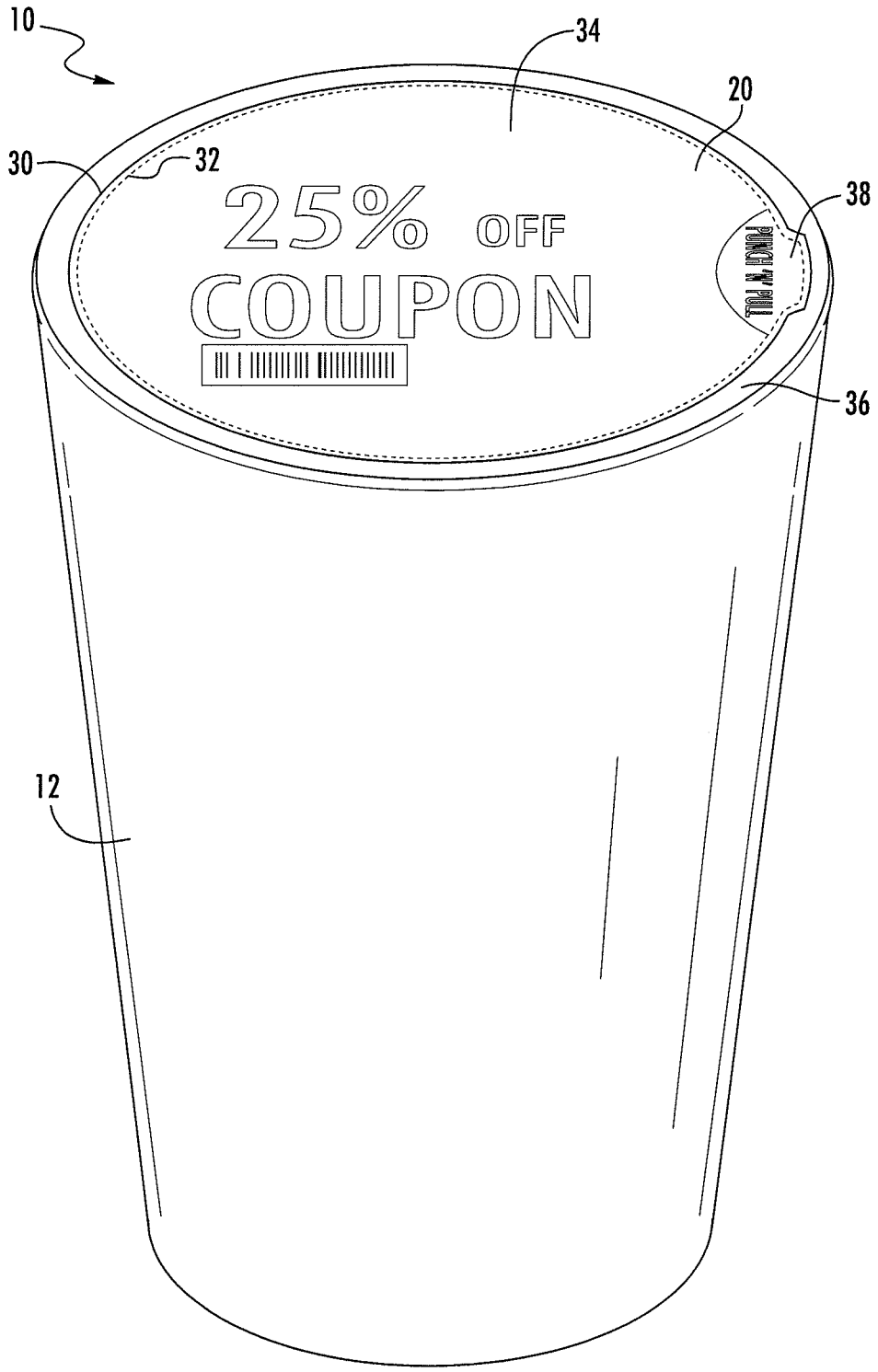
FIG. 1 is a perspective view of a container in accordance with one embodiment of the invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A container 10 in accordance with one embodiment of the invention is depicted in FIGS. 1 through 7. The container comprises a can body 12 and a lid 20 attached to the can body. As shown in FIG. 4B for example, the can body 12 can be a paperboard or composite can body having an upper rim 14 formed as an outwardly rolled bead. Alternatively, the can body could be formed of different material (e.g., plastic) and the upper rim could be formed by other means (e.g., a molded flange or the like). The construction of the can body is of no relevance to the present invention.

Figure 2:
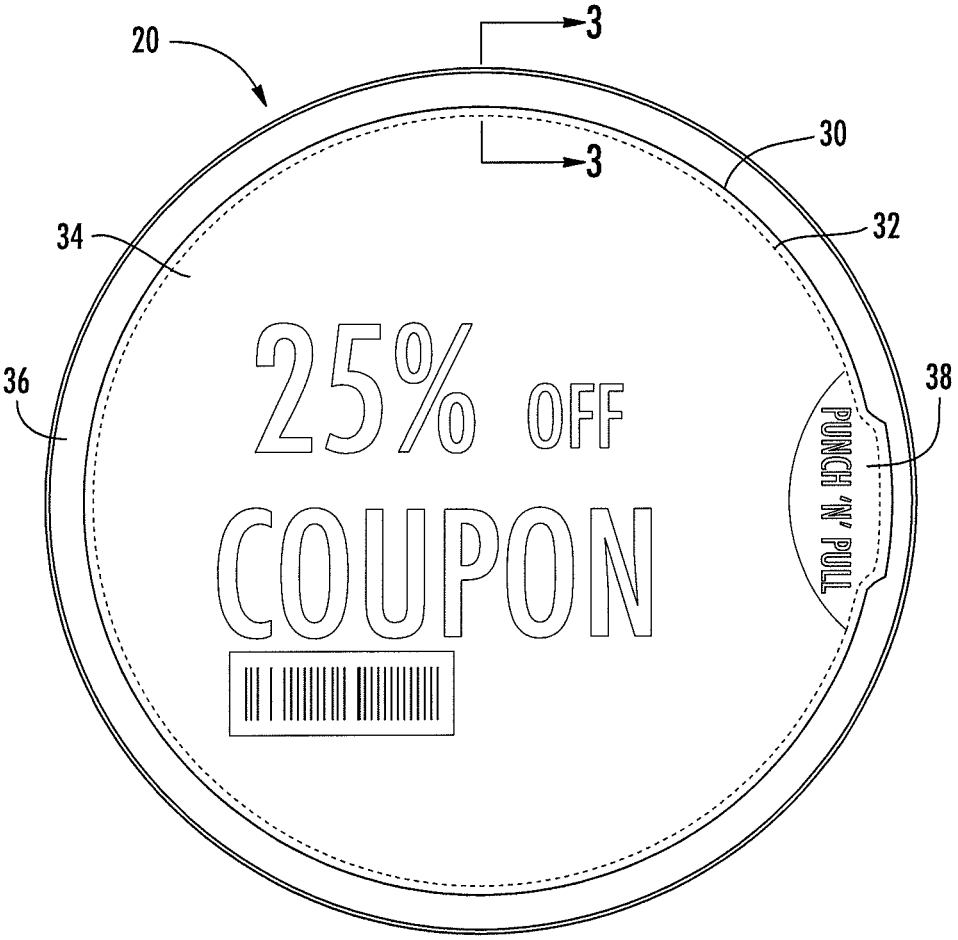
FIG. 2 is a top view of the lid for the container of FIG. 1.
Figure 3:
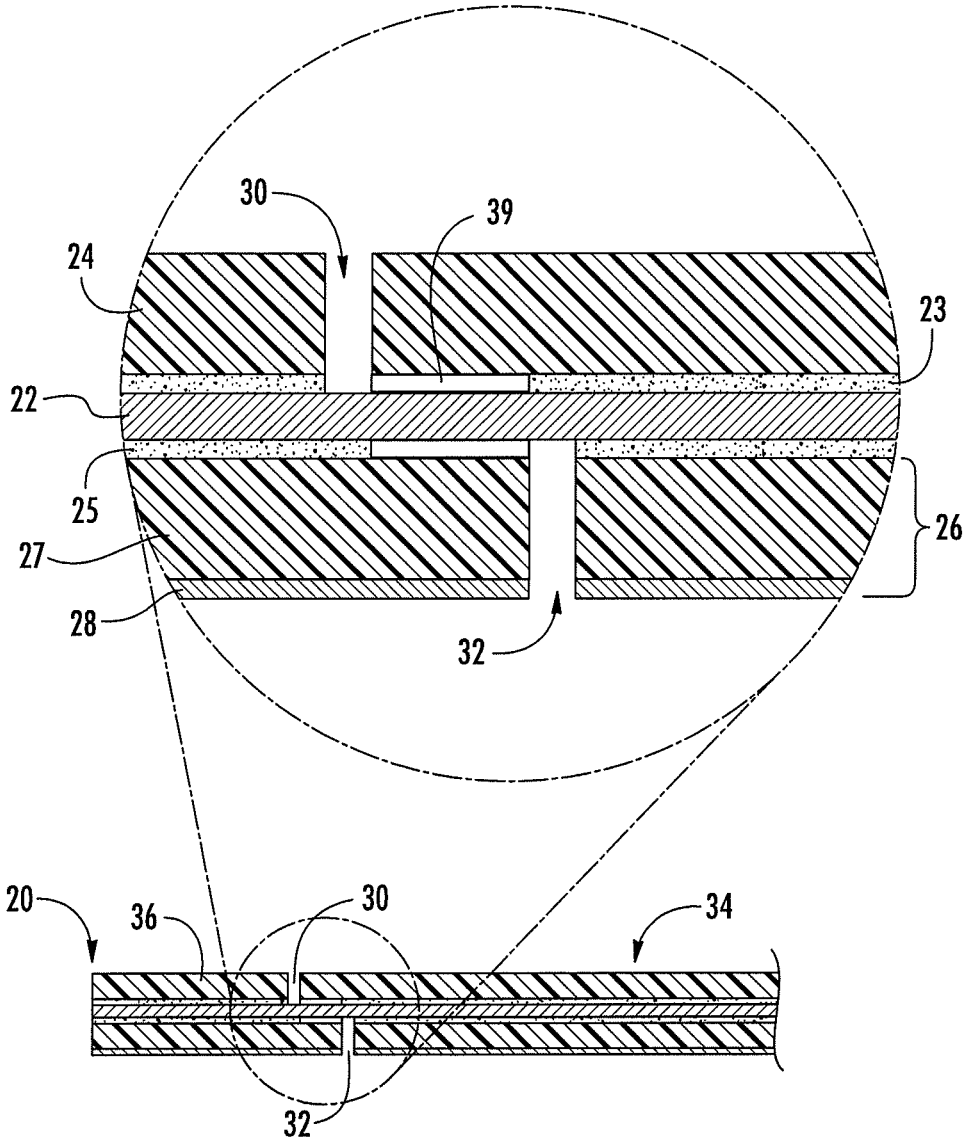
FIG. 3 is a cross-sectional view through the lid along line 3-3 in FIG. 2.

With reference to FIGS. 2 and 3, the lid 20 comprises a flexible buried-foil membrane formed as a laminate of multiple layers. The layers include a metal foil layer 22 having a first side and an opposite second side, a first non-metal structure 24 adhered via a first adhesive layer 23 to the first side of the metal foil layer 24, and a second non-metal structure 26 adhered via a second adhesive layer 25 to the second side of the metal foil layer 24. Thus, the term "buried-foil laminate" as used herein means a laminate in which there is an intermediate metal foil layer sandwiched between non-metal structures. The term "non-metal structure" as used herein means a structure that does not include a metal foil, but does not exclude the presence of metal in very small amounts. For example a polymer film or a paper layer having a very thin vacuum-deposited layer of metal (i.e., a metallized film or metallized paper) is a "non-metal structure" as the term is defined herein.

Figure 4A:
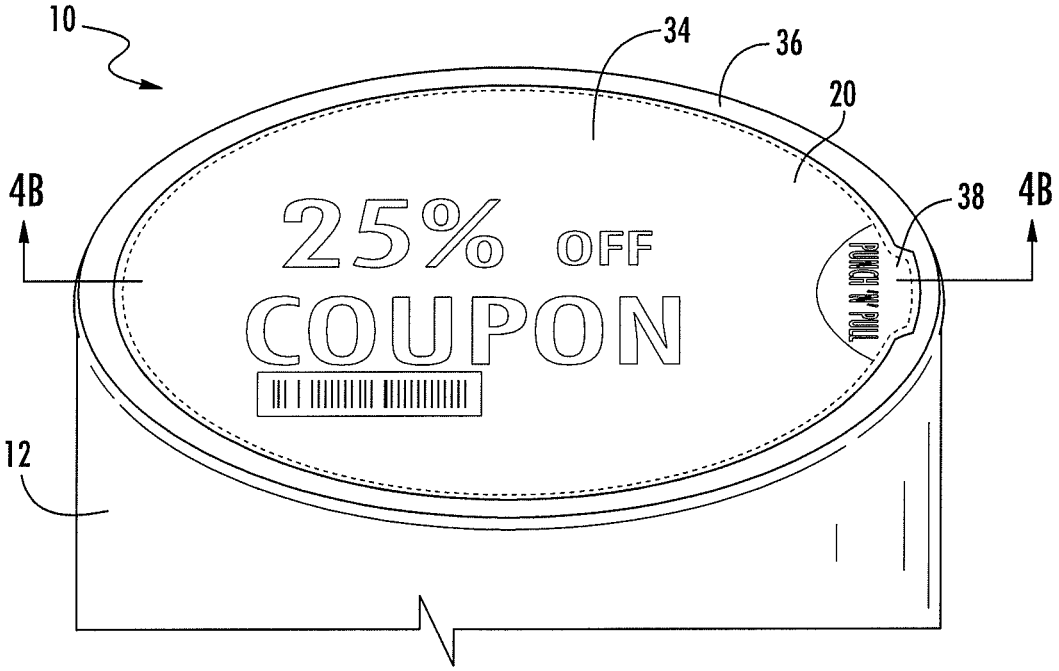
FIG. 4A is a perspective view of an upper portion of the container of FIG. 1.
Figure 4B:
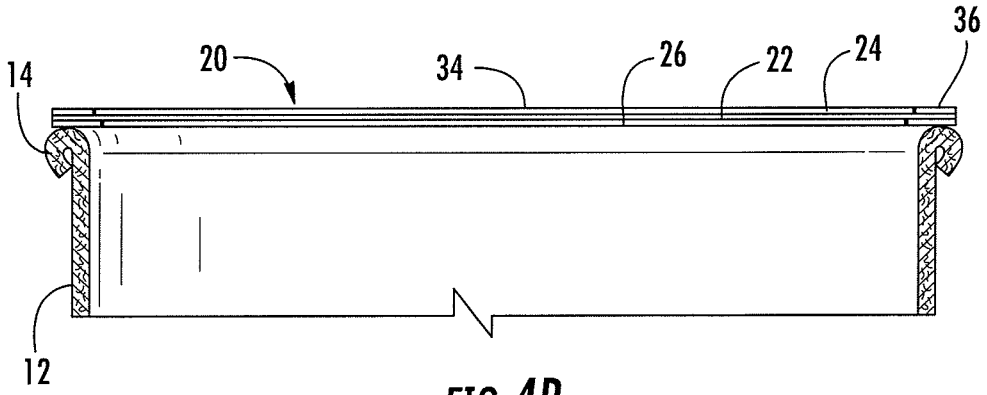
FIG. 4B is a cross-sectional view along line 4B-4B in FIG. 4A.

As illustrated, the first structure 24 comprises a single layer of polymer film. Any of various suitable polymer materials can make up the first structure 24, such as polyethylene, polypropylene, polyester (e.g., PET), and the like. The second structure 26 is illustrated as comprising a polymer film layer 27 and a sealant layer 28. The polymer film layer 27 can comprise any of the aforementioned polymer materials, and can be the same polymer or a different polymer from that of the first structure 24. The sealant layer 28 can be any suitable sealant material for affixing the lid 20 to the upper rim 14 of the can body 12 (FIG. 4B). For example, the sealant layer 28 can comprise a heat-sealable material.

Further referring to FIGS. 2 and 3, the lid 20 includes a press-and-pull opening feature. The opening feature includes a first score line 30 forming a complete loop and extending through a thickness of the first structure 24 but not breaching the metal foil layer 22, and a second score line 32 forming a complete loop and extending through a thickness of the second structure 26 but not breaching the metal foil layer 22, the second score line 32 being generally aligned with the first score line 30 as shown in FIG. 2. The first and second score lines together encompass a removable panel portion 34 of the flexible membrane, and the flexible membrane includes an outlying portion 36 that completely surrounds the removable panel portion 34.

The opening feature further comprises a press-and-pull tab 38 constituting part of the removable panel portion 34. A segment of the first score line 30 and a corresponding segment of the second score 32 line separate an outer edge of the press-and-pull tab 38 from the outlying portion 36 of the flexible membrane. In other words, the tab 38 is wholly contained within the membrane and does not project beyond an outer periphery of the lid 20.

Figure 5A:
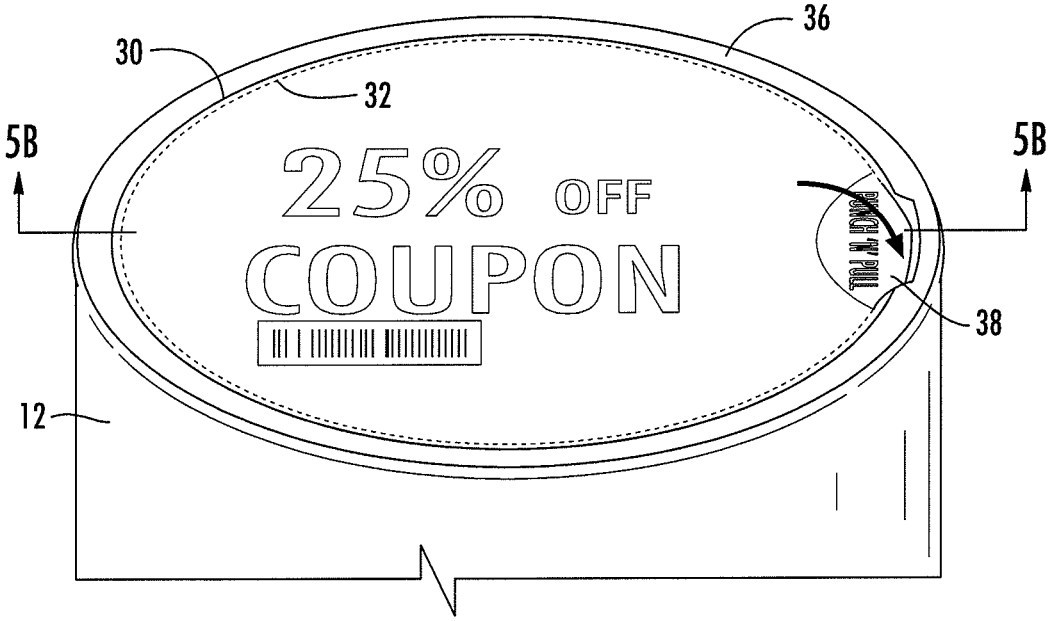
FIG. 5A is a view similar to FIG. 4A, illustrating a first step in a sequence of steps for opening the container, wherein the press-and-pull tab is pressed downwardly.
Figure 5B:
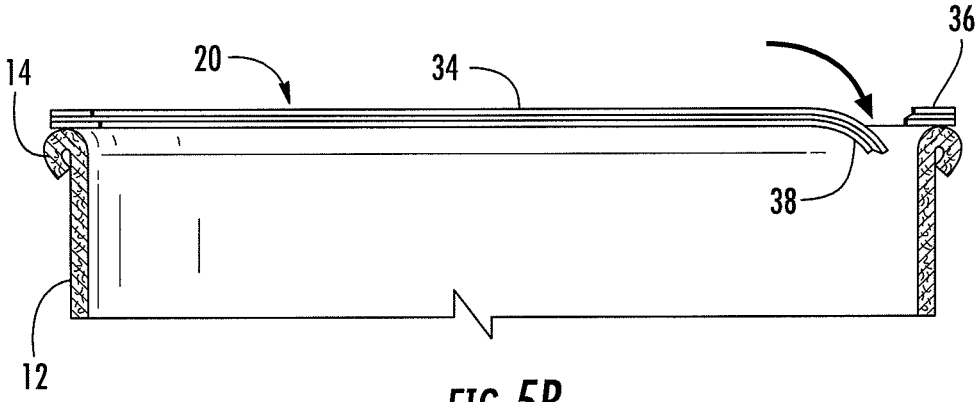
FIG. 5B is a cross-sectional view along line 5B-5B in FIG. 5A.

With reference to FIGS. 5A and 5B, a first step in a sequence of steps for opening the press-and-pull opening feature is shown. The press-and-pull tab 38 is first pressed downward generally normal to the flexible membrane 20 to cause the metal foil layer 22 to break in the region of the outer edge of the press-and-pull tab 38 so as to sever the outer edge of the press-and-pull tab from the outlying portion 36 of the flexible membrane.

Figure 6A:
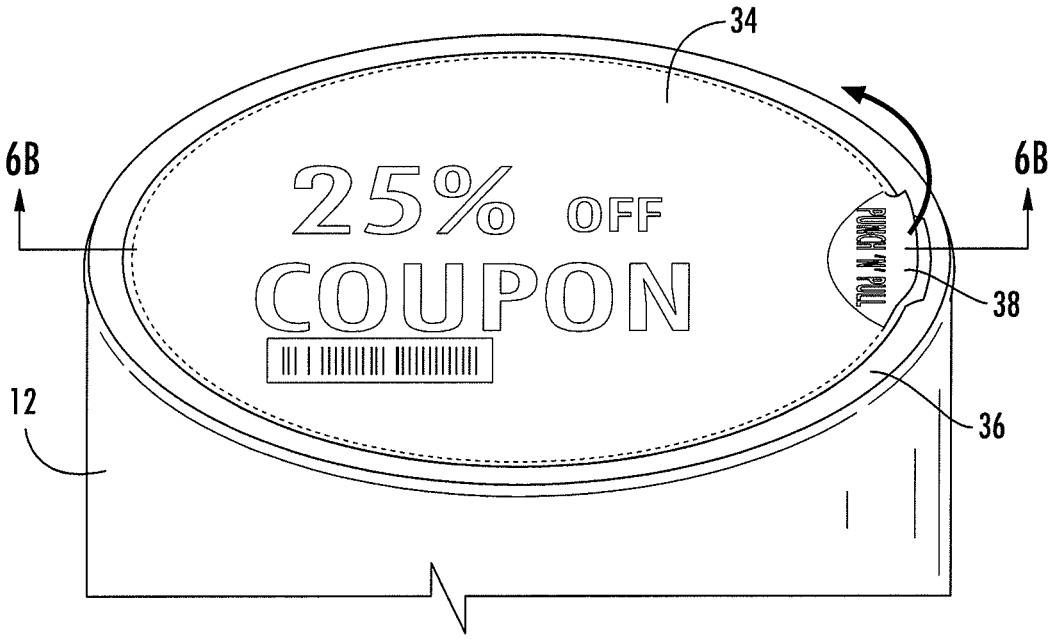
FIG. 6A is a view similar to FIG. 4A, illustrating a second step in the sequence of steps for opening the container, wherein the press-and-pull tab is pulled upwardly to begin severing the foil layer about the periphery of the removable panel portion.
Figure 6B:
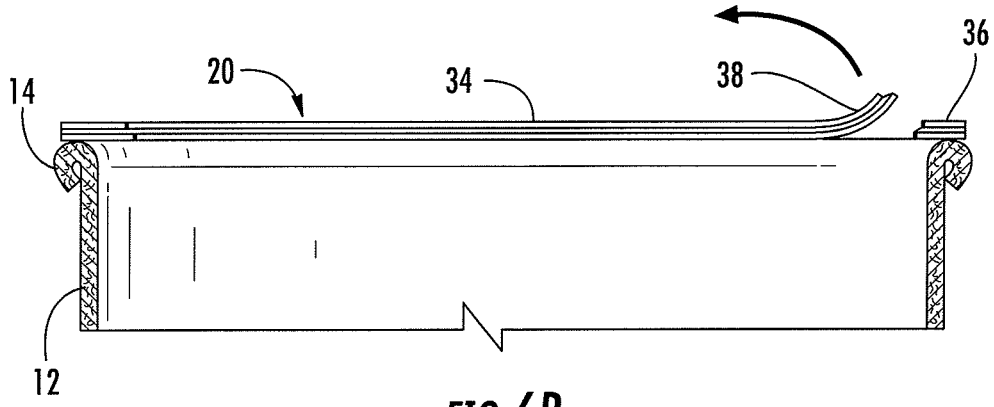
FIG. 6B is a cross-sectional view along line 6B-6B in FIG. 6A.
Figure 7A:
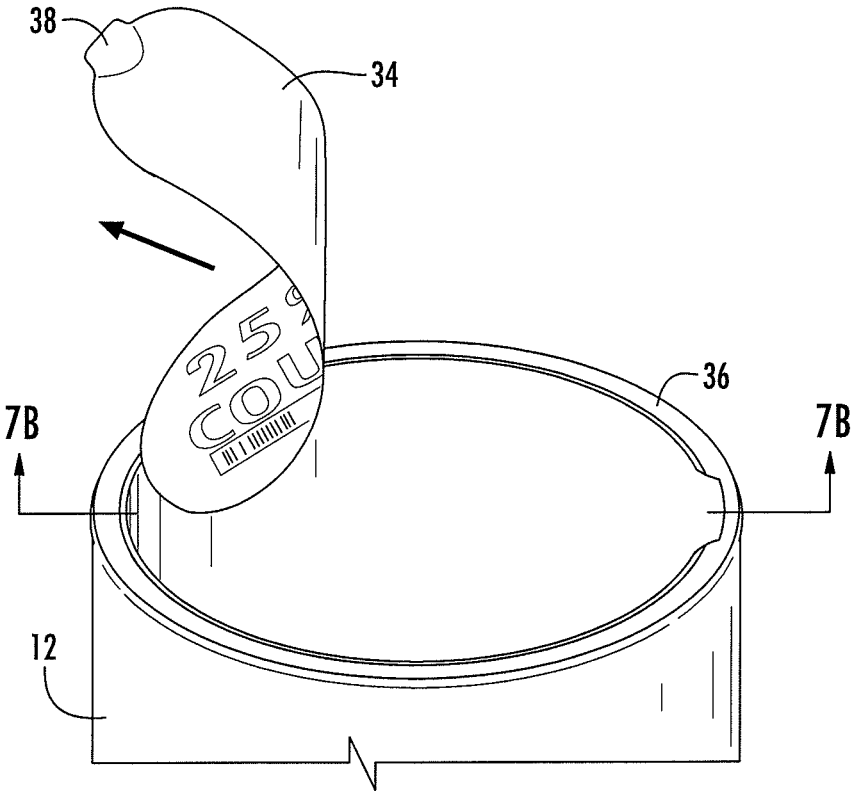
FIG. 7A is a view similar to FIG. 4A, illustrating a final step in the sequence of steps for opening the container, wherein the removable panel portion has been completely detached from the rest of the lid.
Figure 7B:
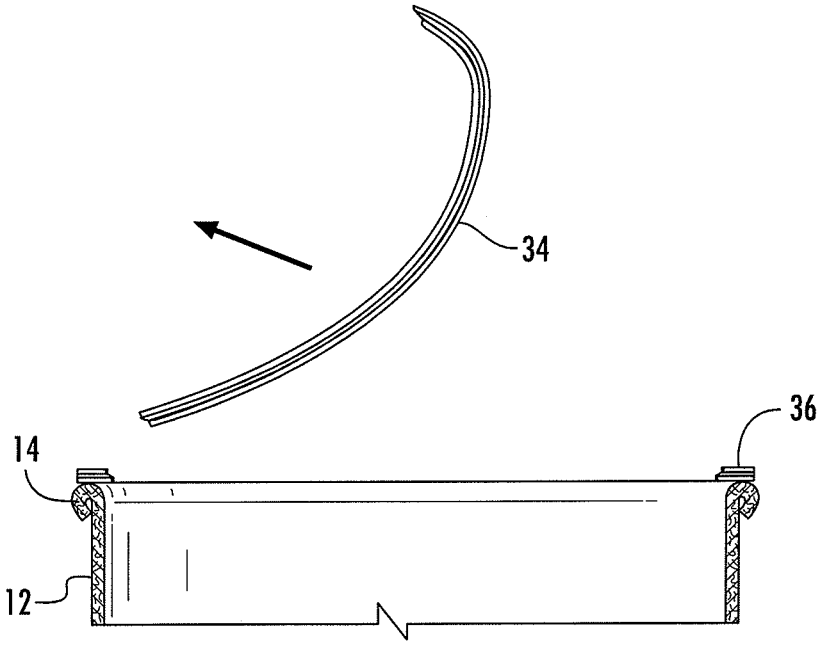
FIG. 7B is a cross-sectional view along line 7B-7B in FIG. 7A.

With reference to FIGS. 6A and 6B, the next step in the sequence of opening operations is to grasp the tab 38 and pull it upward to cause the metal foil layer to break all around a periphery of the removable panel portion 34 to enable the removable panel portion to be completely removed from the outlying portion 36 of the flexible membrane that remains affixed to the upper rim 14 of the can body 12 as shown in FIGS. 7A and 7B.

With reference again to FIG. 3, the first score line 30 and the second score line 32 can be coincident, but may be offset as illustrated. When they are offset, it is advantageous to include an adhesive-free "knock-out" region 39 in the region bounded between the two offset score lines. In the knock-out region 39 the adhesive of the first adhesive layer 23 is absent. This knock-out region is helpful in weakening the membrane so that the metal foil layer 22 can more-readily be fractured by pressing down on the tab 38. The knock-out region 39 can be present only in the vicinity of the tab 38 or can be present all around the periphery of the removable panel portion 34.

In the illustrated embodiment of FIGS. 1-7, the upper rim 14 of the can body 12 and the lid 20 are shown as round. However, the invention is not limited to any shape, and the upper rim and the lid each can have a plan view shape selected from the group consisting of round, non-round, and polygonal.

Figure 8:
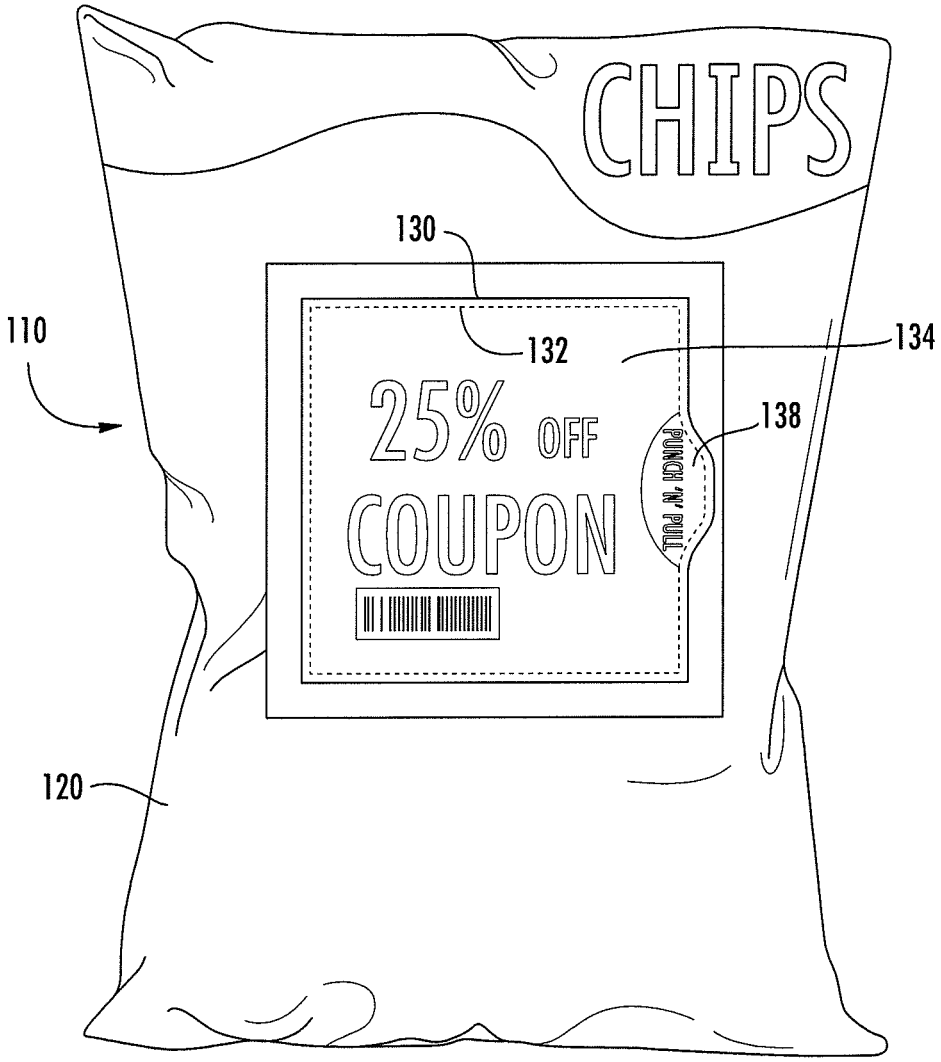
FIG. 8 is a front view of a container in accordance with another embodiment of the invention.

As noted, the invention is not limited to lids for can bodies. FIG. 8 depicts a container 110 comprising a bag or pouch that is formed from a flexible membrane 120. One wall (e.g., a front wall as shown) of the container can include a press-and-pull opening feature formed by a first score line 130 and a second score line 132 delineating a removable panel portion 134, and a press-and-pull tab 138 generally as described above in the first embodiment. The structure of the membrane 120 can be substantially like that described for the membrane 20 of the first embodiment, and the operation of the opening feature is also substantially the same.

As shown in the figures, because the removable panel portion 34, 134 comes completely out cleanly, it can be a coupon that can be applied toward the future purchase of the same product or a different product.

The score lines 30, 32, 130, 132 advantageously can be foamed by using a laser to ablate material of the first structure 24 (FIG. 3) and a laser to ablate material of the second structure 26. In each case, the laser is tuned and has appropriate power density to ablate all the way through the thickness of the respective structure without penetrating through the metal foil layer 22.

Two different types of containers 10 and 110 have been illustrated, but the invention is not limited to these types. Indeed, the invention can be applied to any container that includes a flexible buried-foil laminate membrane forming part or all of the container, wherein it is desired to form an opening feature in the flexible membrane.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container at least part of which is formed by a flexible membrane having a press-and-pull opening feature, wherein:

the flexible membrane comprises a laminate of a metal foil layer having a first side and an opposite second side, a first non-metal structure adhered via a first adhesive layer to the first side of the metal foil layer, and a second non-metal structure adhered via a second adhesive layer to the second side of the metal foil layer; and the press-and-pull opening feature comprises:

a first score line forming a complete loop and extending through a thickness of the first structure but not breaching the metal foil layer;

a second score line forming a complete loop and extending through a thickness of the second structure but not breaching the metal foil layer, the first and second score lines together encompassing a removable panel portion of the flexible membrane, wherein the flexible membrane includes an outlying portion that completely surrounds the removable panel portion; and a press-and-pull tab constituting part of the removable panel portion, wherein a segment of the first score line and a corresponding segment of the second score line separate an outer edge of the press-and-pull tab from the outlying portion of the flexible membrane, and wherein the press-and-pull tab is arranged to first be pressed downward generally normal to the flexible membrane to cause the metal foil layer to break in the region of the outer edge of the press-and-pull tab so as to sever the outer edge of the press-and-pull tab from the outlying portion of the flexible membrane, and then to be grasped and pulled upward to cause the metal foil layer to break all around a periphery of the removable panel portion to enable the removable panel portion to be completely removed from the flexible membrane.

2. The container of claim 1, wherein at least in the vicinity of the press-and-pull tab the second score line is offset from the first score line, and wherein the first adhesive layer is absent in a region bounded between the offset first and second score lines.

3. The container of claim 2, wherein the first and second score lines are offset from one another all around the periphery of the removable panel portion.

4. The container of claim 1, wherein the container comprises a can body having an upper rim, and the flexible membrane comprises a lid attached to the upper rim, wherein the first structure is exposed at an outer surface of the container and the second structure is adjacent an interior of the container, and the second structure at least in the outlying portion of the flexible membrane includes a heat-sealable material that is heat-sealed to the upper rim, wherein the outlying portion is the only part of the flexible membrane that is heat-sealed to the upper rim, and the outlying portion remains attached to the upper rim after the removable portion of the flexible membrane is removed.

5. The container of claim 4, wherein the upper rim and the lid each has a plan view shape selected from the group consisting of round, non-round, and polygonal.

6. The container of claim 5, wherein the removable portion of the flexible membrane has a plan view shape geometrically similar to that of the lid.

7. The container of claim 1, wherein the container comprises a bag or pouch constructed of the flexible membrane.

8. The container of claim 7, wherein the removable portion of the flexible membrane has a plan view shape selected from the group consisting of round, non-round, and polygonal.

9. The container of claim 1, wherein the first structure comprises at least a first polymer film layer and the second structure comprises at least a second polymer film layer.

10. The container of claim 9, wherein the second structure additionally comprises a third polymer film layer, wherein the second polymer film layer has one surface adhered to the second side of the metal foil layer, and the third polymer film layer is disposed adjacent an opposite surface of the second polymer film layer.

11. The container of claim 10, wherein the third polymer film layer is a sealant material.

12. The container of claim 11, wherein the sealant material is a heat-sealable material.

* * * * *